United States Patent [19]

Clare

[11] 4,227,758

[45] Oct. 14, 1980

[54] CONNECTORS FOR HOLDING TOGETHER MODULAR ARTICLES

[76] Inventor: George M. Clare, 299 Hartshorn Dr., Short Hills, N.J. 07078

[21] Appl. No.: 897,960

[22] Filed: Apr. 20, 1978

[51] Int. Cl.[2] ..... F16B 12/00; A47F 3/14

[52] U.S. Cl. ..... 312/107; 312/111; 312/140; 211/126; 220/23.4

[58] Field of Search ..... 312/111, 107, 108, 140, 312/195, 278, 198; 220/23.4, 23.6; 211/126, 194

[56] References Cited

U.S. PATENT DOCUMENTS

| | | | |
|---|---|---|---|
| 1,147,975 | 7/1915 | Ruff | 211/126 |
| 1,951,972 | 3/1934 | Fraser | 211/126 |
| 2,537,219 | 1/1951 | Girton | 312/107 |
| 2,565,448 | 8/1951 | Brownell | 220/23.4 |
| 2,825,614 | 3/1958 | Card | 312/111 |
| 3,038,599 | 6/1962 | Poupitch | 220/23.4 |
| 3,497,279 | 2/1970 | Chovanec | 312/108 |
| 3,552,579 | 1/1971 | Simon | 312/111 |
| 3,735,548 | 5/1973 | Ferrari et al. | 211/194 |
| 3,836,217 | 9/1974 | Shiina | 312/107 |
| 3,964,809 | 6/1976 | Wirbilowicz et al. | 312/108 |
| 4,015,886 | 4/1977 | Wickenberg | 312/111 |

*Primary Examiner*—Victor N. Sakran

*Attorney, Agent, or Firm*—McAulay, Fields, Fisher, Goldstein & Nissen

[57] ABSTRACT

A connector for holding together a plurality of pocket style molded containers or other modular articles and having a web bearing retainers providing channels that engage and receive edge portions of the containers or articles to hold them in a predetermined configuration established by the arrangement of the retainers on the web.

12 Claims, 9 Drawing Figures

CONNECTORS FOR HOLDING TOGETHER MODULAR ARTICLES

BACKGROUND AND SUMMARY OF THE INVENTION

The present invention relates, in general, to connectors for holding together plural articles, and more particularly, to connectors for holding plural modular articles together in a predetermined configuration.

In the use of certain modular articles, such as pocket style containers, it is desirable to have several of them grouped together in a selected arrangement. It is also desirable to have arrangements of containers or other articles in which a basic configuration can be repeatedly extended to build up an assembly of many interconnected units.

For containers, it is frequently useful to have them arranged so that their respective contents are visible and/or readily accessible, as when storing quantities of different size hardware. There are a variety of container connectors known in the prior art and adapted for special purposes. For example, in U.S. Pat. No. 1,849,659, there is disclosed a support and spacer for stacking open-top boxes whereby the lowermost box is held at an inclination to the horizontal, and successive boxes are stacked one upon another with front ends set back to provide access to each box.

In U.S. Pat. No. 2,565,448, there is disclosed a pail holder which grips two adjacent pails at top and bottom for carrying together in side-by-side relation. In U.S. Pat. No. 3,107,131, there is disclosed a sectional drawer cabinet in which modular holders for receiving individual drawers are interconnected horizontally and vertically to form an extended drawer cabinet.

In U.S. Pat. No. 3,841,725, there is disclosed shelving units that can be interconnected for extended capacity. In U.S. Pat. No. 3,964,809, there is disclosed a modular cabinet structure with interconnected units, and in U.S. Pat. No. 4,015,886, there is disclosed storage bins interconnected in tiers for display and access.

The subject invention provides a somewhat different type of connector that can be used singly or in groups to hold together a plurality of modular pocket containers, each of the type having plural edge portions. Such connector basically comprises a web member, and a plurality of retainer members connected to the web member for support thereby and which are positioned to engage respective edge portions of individual containers to hold said containers together in a predetermined configuration. The particular configuration in which the containers are held is determined by the positioning of the retainer members on the web in accordance with the several embodiments of the invention.

The typical modular container has two opposed side walls each having an upper edge portion and a lower edge portion. These edge portions are generally parallel and are spaced apart a distance corresponding to the height of the connector. In accordance with the invention, the connector to support such container comprises a web having a pair of integrally connected retainer members. Each retainer member defines a channel that receives and retains a corresponding edge portion of the container wall that is placed against the connector web.

A variety of container holding configurations are provided by the invention including a side-by-side configuration in which a pair of containers are held one on each side of the connector web; an adjacent in-line configuration in which a pair of containers are held along a common side of the web either vertically superposed or back-to-back; and an adjacent staggered configuration in which a pair of containers held along a common side of the web are vertically spaced with the front of the upper container set back from that of the lower container. These basic configurations can be repeated along a lateral build-up line, using multiples of a typical connector to form a large group of interconnected containers.

For a better understanding of the invention and its advantages, reference should be had to the accompanying drawings and following detailed description which together exemplify certain preferred embodiments of the invention.

DESCRIPTION OF THE PREFERRED EMBODIMENTS OF THE INVENTION

Figure 1:
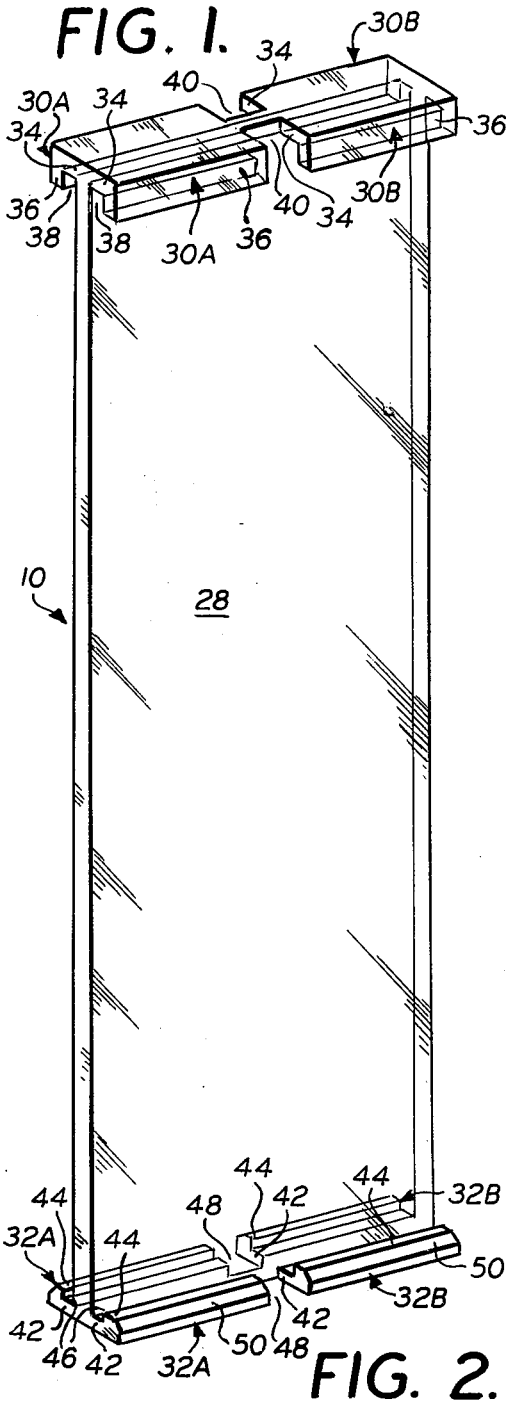
FIG. 1 is an elevation perspective view of a connector constructed in accordance with a preferred embodiment of the invention.
Figure 4:
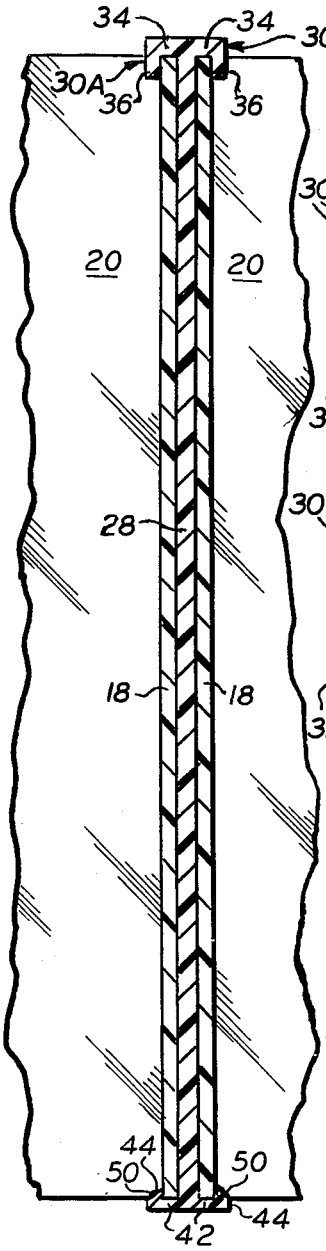
FIG. 4 is a sectional view of the assembly shown in FIG. 3, as taken along line 4—4 therein, showing details of the side walls and edge portions thereof on the containers, and channels defined by retainer members of the connector that cooperate to effect the connection shown.

Referring to the drawings, FIGS. 1-4 exemplify a connector 10 that can be used to hold together a pair of modular, pocket style containers 12 in a predetermined side-by-side configuration.

Figure 2:
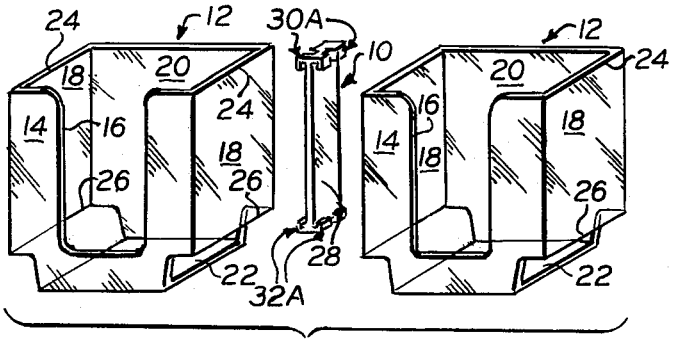
FIG. 2 is an exploded perspective view of the connector shown in FIG. 1 and two modular pocket-type containers that are connectable together by such connector.

The typical container 12 has a front wall 14 with cut-out 16, opposed side walls 18, a back wall 20 and a bottom wall 22 joined together as shown in FIG. 2. Each side wall 18 has an upper edge portion 24 and a lower edge portion 26 that are utilized in the operation of the connector 10 and other embodiments thereof. The lower edge portions 26 are spaced from bottom wall 22 and are off-set with respect to the side edges of said bottom wall to define corner cut-out sections to facilitate cleaning of the container 12, and reduce the amount of material required to manufacture said container and the weight thereof. Edge portions 24 and 26 for each side wall 18 are generally parallel and are spaced-apart a distance corresponding to the height of the connector 10. As previously indicated, the height of the side walls 18 are somewhat less than the actual height of container 12 by an amount equal to the elevation difference between lower edge portions 26 and the bottom wall 22.

For purposes of example, the invention is described in terms of containers 12, but the artisan will understand that other types of modular articles (not shown) could be held together with the same type of connectors.

Figure 3:
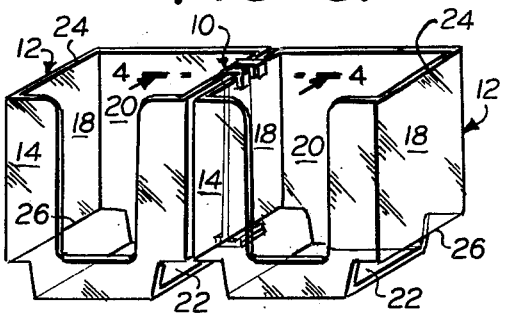
FIG. 3 is a perspective view of an assembly of the connector and containers shown in FIG. 2, as seen with the containers connected together side-by-side through the use of the connector.

Referring to FIG. 1. connector 10 is illustrated as comprising a web member 28 and a plurality of retainer members 30A, 32A, 30B, 32B connected to web member 28 for support thereby and, as shown by FIGS. 2 and 3, positioned to engage respective edge portions 24, 26 of the containers 12 to hold a pair thereof together in a predetermined, side-by-side, configuration.

Each of the aligned upper retainer members 30A, 30B can be considered as connected to the top of web member 28 by a flange 34 which terminates in a downwardly projecting leg portion 36 spaced from and substantially parallel to web member 28 to define a channel 38 that extends transverse and parallel to the longitudinal extent of said web member. A cut-out or notch 40 is formed approximately midway the cross width of web member 28 to define a space which separates retainer members 30A and 30B for reasons hereinafter apparent in holding together a pair of containers 12 in back-to-back or side-by-side configuration.

Similarly, each of the aligned lower retainer members 32A, 32B is connected to the bottom of web member 28 by a flange 42 which terminates in upwardly projecting leg portion 44. The flanges 42 and leg portions 44 of lower retainer members 32A, 32B function respectively in the same basic manner as do the flanges 34 and leg portions 36 of the upper retainer members 30A, 30B. For each retainer member 32A, 32B, its flange 42 and leg portion 44 define with the adjacent portion of web member 28 a channel 46 that extends similarly to a typical channel 38. A notch 48 is also formed approximately midway the cross width of web member 28 to define a space which separates retainer member 32A and 32B for holding a pair of containers 12 in the manner hereinafter described.

On connector 10, the channels 38 associated with upper retainer members 30A, 30B are oppositely facing the channels 46 associated with corresponding lower retainer members 32A, 32B. Furthermore, it will be appreciated that the flanges 34 and 42 can be formed integral with web member 28.

In the side-by-side connection of containers 12 as in FIGS. 2 and 3, the upper edge portions 24 are received and retained in the channels 38 of upper retainer members 30A, 30B whereas the lower edge portions 26 are received and retained in the channels 46 of the lower retainer members 32A, 32B. From FIG. 4, it can be noted that the distance between the bottoms of respective channels 38 and 46 on each common side of web member 28 is essentially the same as the distance between the corresponding container edge portions 24, 26 that are held in such channels 38, 46. Also, the width of each channel 38, 46 is essentially the same as the thickness of the corresponding edge portion 24, 26 held thereby.

The connector 10, as are the containers 12, are expediently molded from plastic. This gives a certain flexibility to the connector 10, particularly to the web member 28 thereof. Leg portions 36 of upper retainer members 30A, 30B are greater in length than leg portions 44 of lower retainer members 32A, 32B, which makes upper channels 38 deeper than lower channels 46. To facilitate snapping connector 10 over the edge portions 24, 26 of the containers 12, the lower leg portions 46 are chamfered as at 50. In use, as when connecting a pair of containers 12 in side-by-side relation, the upper leg portions 36 are slipped over the upper edge portions 24 of said containers so as to locate said edge portions 24 in the upper channels 38. The lower leg portions 44 are then snapped over the lower edge portions 26 of said containers with the aid of the cam-like action provided by the chamfers 50 so as to locate said edge portion 26 in the lower channels 46.

In the manufacture of containers 12 by plastic molding, it has been found advantageous to make the width of the container 12 at the upper edge portions 24 slightly greater than its width at the lower edge portions 26. By providing such difference in width, there is achieved sufficient draft for removing the container 12 from its manufacturing mold. In connector 10, the width difference in container 12 is compensated for by tapering the surfaces of web member 28 to match so that the containers 12, when connected together, will be in substantially parallel orientations.

In other words, web member 28 is formed having a taper increasing in the direction toward the lower retainer members 32A, 32B. The increased thickness of the web at the juncture of the lower flanges 42 provides increased strength to the connector 10 in the region of maximum stress.

Figure 6:
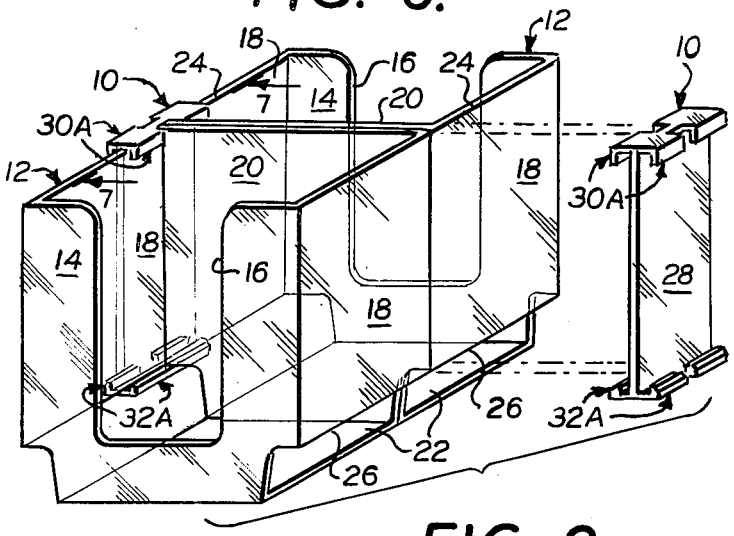
FIG. 6 is an exploded perspective view, showing how two modular containers can be connected together in a back-to-back configuration using connectors of the type shown in FIG. 1.
Figure 7:
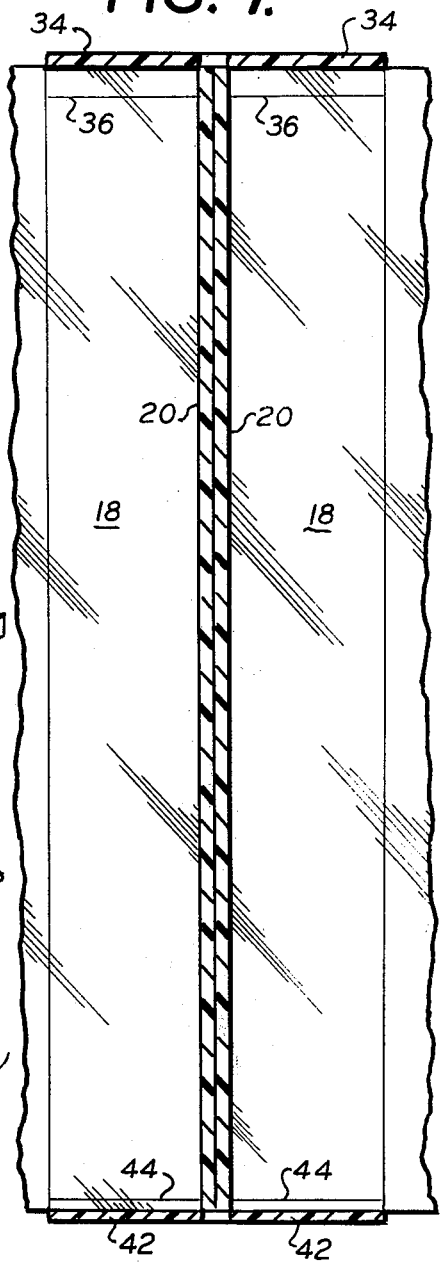
FIG. 7 is a sectional view taken along line 7—7 in FIG. 6, and showing how the back walls of the containers are held together in abutment by a typical connector.

When connector 10 is used, as in FIGS. 6 and 7, to hold containers 12 in back-to-back relation, the spaces 40, 48 function as slots permitting the connector 10 to bridge over or straddle the contiguous back walls 20 of the containers 12.

When connecting together containers 12 in side-by-side relation, as in FIGS. 2 and 3, an extended row of containers 12 can be interconnected using a single connector 10 between each pair of adjacent containers.

Likewise, the single pair of containers 12 interconnected back-to-back as in FIGS. 6 and 7 can be expanded sideways by interconnecting additional pairs of back-to-back containers 12 using the retainer members 30A, 30B, 32A, 32B left available on the right side and left side of the connectors 10 that hold together the single pair of containers shown.

Basically, a single pair of parallel, spaced upper and lower retainer members 30A, 32A suffice for holding each side wall 18 of the front-facing container 12 in FIG. 6, and another single pair of upper and lower retainer members 30B, 32B suffice for holding each side wall 18 of the rear-facing container in FIG. 6. This concept generally applies to other embodiments of the invention and to the side-by-side connection of containers 12 as in FIGS. 2 and 3.

Figure 5:
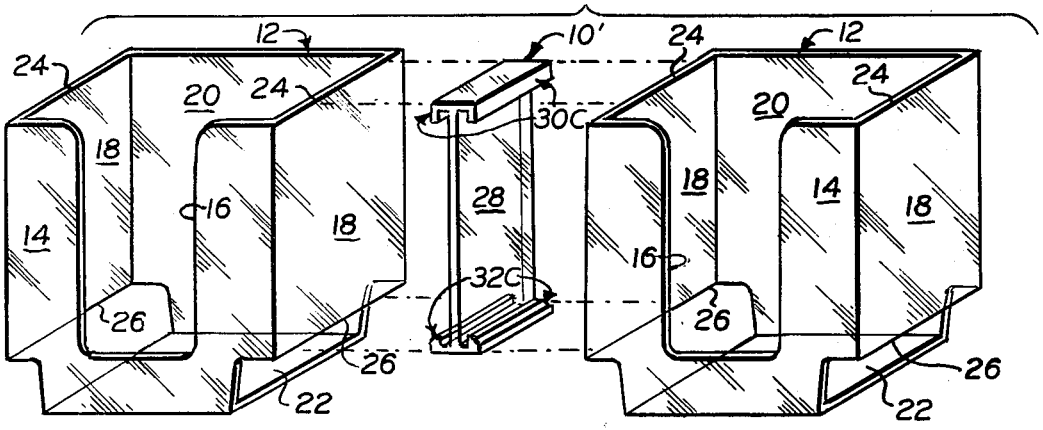
FIG. 5 is an exploded perspective view, similar to FIG. 2, showing two modular containers that are connectable together in a side-by-side configuration using a connector that is somewhat modifed over that shown in FIG. 1.

In FIGS. 2 and 3, the use of a connector 10 with two pairs of retainer members (30A, 32A, 30B, 32B) on each side of the web member 28 gives a certain redundancy for this particular type of configuration, although having such retainer members arrangement allows a single type connector 10 to be used also for back-to-back connections. Where such versatility is not required, a connector 10' can be used, as in FIG. 5, for a side-by-side connection to containers 12. Connector 10' is similar to connector 10, except that on connector 10' there is only a single pair of retainer members 30C, 32C on each side of web member 28.

Figure 8:
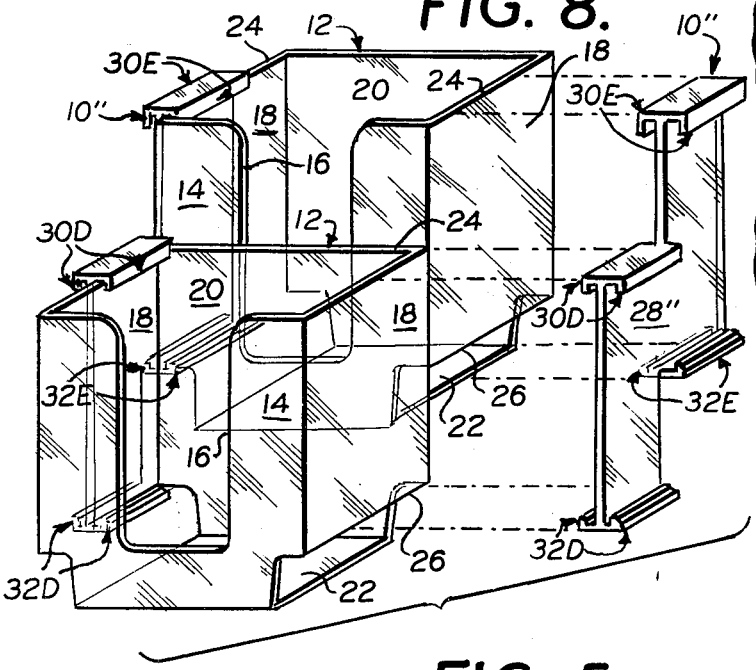
FIG. 8 is an exploded perspective view, showing how two modular containers can be connected together in a vertically staggered relation using connectors according to another embodiment of the invention.

As long as there are provided a set or pair of upper and lower retainer members for each side wall 18 to be held, the shape of the connector web can be changed for different holding configurations. In FIG. 8, there are shown two connectors 10'' in which the web member 28'' has a Z-shape. On each connector 10'', are retainer members 30D, 32D for holding the front container 12 and retainer members 30E, 32E for holding the rear container 12. The set of retainer members 30E, 32E are so positioned in relation to the set of retainer members 30D, 32D that the front and rear containers 12 are held in an adjacent, staggered configuration with both containers being along a common side of the web member 28'' in each connictor 10'', and spaced in elevation.

Figure 9:
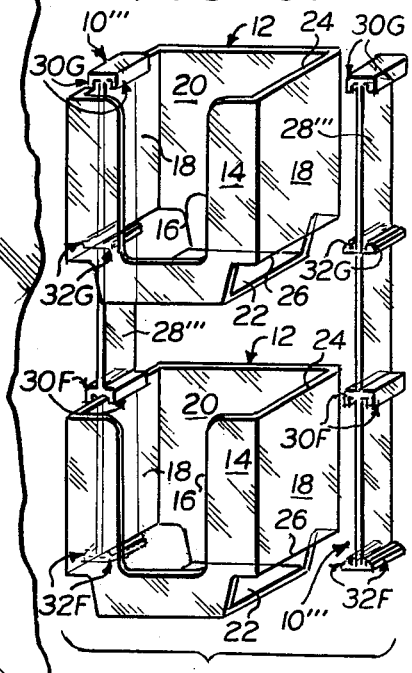
FIG. 9 is an exploded perspective view, showing how two modular containers can be connected together in an inline, vertically spaced relation using connectors according to a further embodiment of the invention.

In FIG. 9 there are shown two connectors 10''' each of which has an elongated rectangular web member 28'''. On each side of web member 28''', there is provided a pair of lower retainer members 30F, 32F, and a pair of upper retainer members 30G, 32G that are positioned so as to hold an upper container 12 and a lower container 12 in an in-line, vertically spaced-apart configuration, with both containers 12 along a common side of each web member 28'''.

While the retainer member arrangement in each connector is different, each of the connectors 10, 10'' and 10''' has a plurality of pairs of retainer members, (30A, 32A and 30B, 32B for connector 10; 30D, 32D and 30E, 32E for connector 10''; and 30F, 32F and 30G, 32G for connector 10''') positioned on each opposite side of its respective web member 28, 28'', 28''', to hold a corresponding plurality of containers 12 on each side of the web member 28, 28'', 28''' in the same configuration. This enables connectors 10, 10'', 10''' to be used for interconnecting expanded groups of containers 12 that are positioned in a repeated basic configuration.

The invention as heretofore described in connection with a few illustrative examples is capable of other variation and modifications that will become apparent to the artisan from the drawings and the description herein. Thus, while preferred embodiments of the invention have been shown and described, it will be readily understood and appreciated that numerous omissions, changes and additions may be made without departing from the scope of the invention.

I claim:

1. A connector for holding together a plurality of modular articles each of the type having a pair of spaced apart upper and lower edge portions, said connector comprising an elongated flexible web member and a plurality of retainer members connected to said web member for support thereby, each of said retainer members including a pair of oppositely facing channels for each of the modular articles to be held together, each channel receiving and retaining a respective edge portion of said pair of upper and lower edge portions, said web member having sufficient flexibility to permit one of the channels of said pair of channels to deflect to snap over the associated edge portion of a modular article, and said retainer members being positioned to hold the plurality of modular articles together in a predetermined configuration.

2. A connector according to claim 1 wherein said retainer members are positioned on opposite sides of said web member to hold a pair of modular articles in a side-by-side configuration, one article on each side of the web member.

3. A connector according to claim 1 wherein said retainer members are positioned on said web member to hold a pair of modular articles in an adjacent, in-line configuration with both modular articles along a common side of the web member.

4. A connector according to claim 3 wherein the modular articles are held in back-to-back relation, said retainer members each having a slot formed therein, and said retainer members being positioned to permit said slots to straddle the contiguous back walls of said modular articles.

5. A connector according to claim 1 wherein said retainer members are positioned on said web member to hold a pair of modular articles in an adjacent, staggered configuration with both modular articles along a common side of the web member and spaced in elevation.

6. A connector according to claim 1 wherein said retainer members are positioned on said web member to hold a pair of modular articles in an in-line, vertically spaced-apart configuration with both modular articles along a common side of the web member.

7. A connector according to claim 1 including a plurality of pairs of said retainer members positioned on each opposite side of said web member to hold a corresponding plurality of modular articles on each side of the web member in the same configuration.

8. A connector according to claim 1 wherein the pair of spaced-apart edge portions of said modular article are parallel to each other and wherein the pair of oppositely facing channels of said retainer members are parallel to each other.

9. A connector according to claim 1 wherein each of said pair of channels is defined by a leg portion establishing the depth of the channel, the leg portion defining one of said channels being longer than the leg portion defining the other channel in the pair whereby said one channel has a deeper depth than said other channel.

10. A connector according to claim 9, wherein said modular articles each have a tapered wall extending between said pair of edge portions, said wall being positioned for abutting contact with said web member, and said web member having a matching tapered surface in said abutting contact with the wall.

11. A connector according to claim 10 wherein the thickness of said tapered web member is greater at the end adjacent the retainer members defining the more shallow channels, and said tape extends therefrom in the direction toward the retainer members defining the deeper channels.

12. A connector according to claim 9 wherein the leg portion defining the channel having the more shallow depth has a chamfered edge to facilitate the snapping of said channel over the edge portion of the modular article.

* * * * *

UNITED STATES PATENT AND TRADEMARK OFFICE

CERTIFICATE OF CORRECTION

PATENT NO. : 4,227,758

DATED : October 14, 1980

INVENTOR(S) : George M. Clare

It is certified that error appears in the above—identified patent and that said Letters Patent is hereby corrected as shown below:

In Column 6, line 57 (corresponding to Claim 11, line 4), the word "tape" should be -- taper --.

Signed and Sealed this

*Twenty-fourth* Day of *February 1981*

[SEAL]

*Attest:*

RENE D. TEGTMEYER

*Attesting Officer*

*Acting Commissioner of Patents and Trademarks*